United States Patent [19]

Hudis et al.

[11] Patent Number: 4,835,412

[45] Date of Patent: May 30, 1989

[54] MOTOR HOME/SOLDOUT DETECTION APPARATUS

[75] Inventors: Scott B. Hudis, West Chester; Craig A. Lewis, Berwyn, both of Pa.

[73] Assignee: Mars Incorporated, McLean, Va.

[21] Appl. No.: 225,404

[22] Filed: Jul. 28, 1988

[51] Int. Cl.[4] ..... G07F 5/22

[52] U.S. Cl. ..... 307/119; 318/490; 221/15; 221/129; 194/200; 194/219; 194/220

[58] Field of Search ..... 307/119, 139, 38, 39, 307/40, 41; 194/200, 210, 211, 212, 215, 217, 218, 219, 216, 220, 221, 231, 239, 240, 241, 242, 243, 244, 267, 268, 305, 306, 307, 312, 314; 221/10, 12, 13, 2, 14, 17, 18, 19, 20, 21, 116, 119, 121, 125; 222/63; 318/490, 98, 258, 261, 269, 273, 362–377

[56] References Cited

U.S. PATENT DOCUMENTS

| | | | |
|---|---|---|---|
| 3,232,400 | 2/1966 | Hendrickson | 221/129 X |
| 3,367,467 | 2/1968 | Ptacek | 194/220 X |
| 3,669,235 | 6/1972 | Breeden | 194/200 |
| 3,756,364 | 9/1973 | Bockholt | 194/216 |
| 3,836,046 | 9/1974 | Bowman | 194/240 X |
| 3,848,718 | 11/1974 | Bookout | 194/200 |
| 3,924,719 | 12/1975 | Bowman | 194/240 |
| 4,354,616 | 10/1982 | Camp | 194/219 X |
| 4,458,187 | 7/1984 | Heiman | 318/490 |
| 4,478,353 | 10/1984 | Levasseur | 221/15 X |

*Primary Examiner*—William M. Shoop, Jr.
*Assistant Examiner*—Paul Ip
*Attorney, Agent, or Firm*—Davis Hoxie Faithfull & Hapgood

[57] ABSTRACT

A motor home/soldout detection scheme which can sense N motors home and/or soldout, using only a two wire interface to each motor. The two wire interface can also be matrixed by row and column to further expand the interfacing ability. By channeling the home signal from the control board through the soldout switch the detection of soldout can be assured.

5 Claims, 1 Drawing Sheet

MOTOR HOME/SOLDOUT DETECTION APPARATUS

FIELD OF THE INVENTION

This invention relates to an improved motor home and soldout condition detecting apparatus. More particularly, this invention relates to such apparatus for monitoring the condition of the product dispensing motors and the availability of product to be dispensed in vending machines.

BACKGROUND OF THE INVENTION

A varity of techniques have been employed in the past to detect (1) when a vending machine dispensing motor has returned to its home position after dispensing a product, and (2) when the product to be vended by that dispensing motor is soldout. Much of the art pertaining to vending machine product delivery motor home detection is described in U.S. Pat. No. 4,458,187 which is assigned to the assignee of the present invention and which is incorporated by reference herein. U.S. Pat. No. 4,458,187 describes a vending machine control and diagnostic apparatus for a vending apparatus having product delivery means such as an electrically operated actuator. An impedance element and a switch are connected in series with each other and in a parallel circuit with the actuator. Opening and closing of the switch are controlled by the operation of the actuator. Whether the actuator is in the appropriate position, open circuited or short circuited, is determined by the control and diagnostic apparatus' detection of changes in impedance of the parallel circuit. In several embodiments disclosed in U.S. Pat. No. 4,458,187, separate run and test signals are supplied to the actuator. In a further embodiment, a 24V DC run signal and a 5V RMS AC test signal are combined on a single wire. The test circuit in that embodiment includes a DC test circuit and an AC test circuit.

Additional prior art in the art of home detection is seen in control apparatus manufactured by Coin Acceptors, Inc. In particular, Coin Acceptors, Inc. employs a scheme which places a motor actuated single pole double throw switch in series with each motor. Home position is detected by detecting short switch opening occurring when the cam actuated switch very briefly opens and then closes at the home position. This scheme shorts the normal open and normal closed contacts of the switch. Only during switch transitions is a circuit "open" detected. This "open" is monitored and used to determine the home position. The system is fundamentally noise sensitive in that noise being received anywhere within the home detect circuitry may give a false home indication. Also, as the actual signal is non-repetitive, there is no way to "check again" the fact of the home position. Additionally, as motor current is passed through the switch contacts and is in fact switched by these contacts, switch life will be shortened.

A further product delivery motor home detection apparatus is described in Dobbins, "Vending Machine Control With Improved Product Delivery Motor Home Detection Motor Speed Control And Power Supply", U.S. Pat. No. 4,785,927 filed Mar. 2, 1987, and assigned to the assignee of the present invention. This application is also incorporated by reference herein.

With respect to detection of a soldout condition, the prior art as opposed to motor home detection, employed a number of different schemes to accommodate the soldout switches. Each of these schemes involves extra wiring which adds to the cost and complexity of the vending machine employing the scheme.

For example, in electronic controlled vending machine, the wiring to the motors is typically by a separate power lead to each motor and a common return lead to a row of motors. This is extended in the case of many motors to require a matrix of common row wires and common column wires. This is also the wiring scheme for the soldout switches, hence an additional set of row plus column wires is employed to sense a soldout condition.

Other less efficient schemes require up to 2 wires for each motor and 2 wires for the soldout switch.

SUMMARY OF THE INVENTION

The present invention eliminates all additional wires required for the soldout switches. The result is a more efficient and cost effective motor home/soldout apparatus.

DETAILED DESCRIPTION

Figure 1:
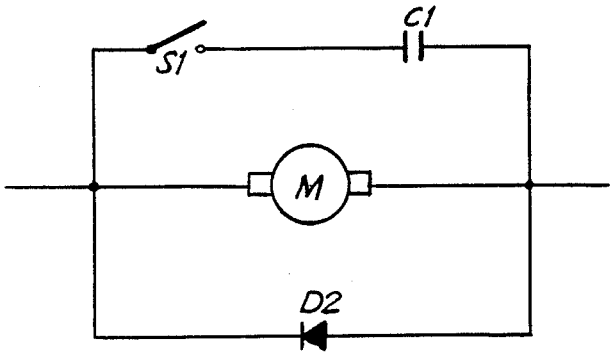
PRIOR ART FIG. 1
FIG. 1 illustrates a prior art motor home sense circuit; of an AC signal riding on a DC bias.
Figure 2:
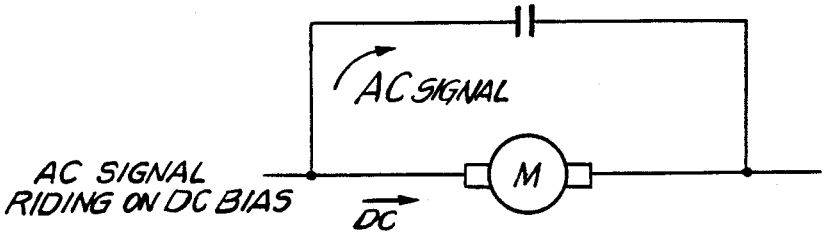
PRIOR ART FIG. 2
FIG. 2 is a diagram illustrating the signal flow, through the parallel connection of a motor and capacitor.
Figure 3:
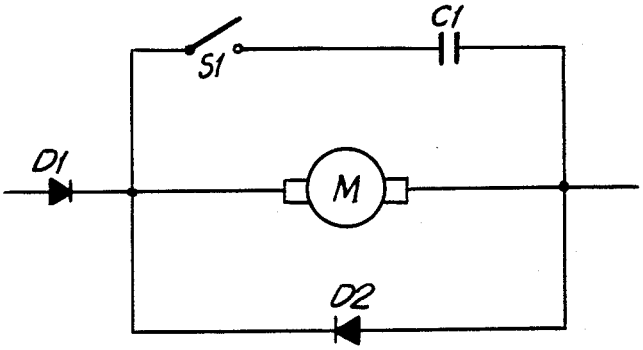
PRIOR ART FIG. 3
FIG. 3 is a motor home sense circuit with a fly back diode and isolation diode added.

The present invention may utilize the previously invented motor home sense circuitry of U.S. Pat. No. 4,458,187 with a product dispenser home circuit such as that shown in FIG. 1. The control circuitry involved in the sensing and running of the product dispensers makes use of the fact that the motor will block an AC signal, but passes a DC signal as shown in FIG. 2. To this end, the circuitry to drive the product dispenser consists of a high frequency signal riding on a DC bias. A fly-back diode and isolation diode may be added to enhance operation as shown in FIG. 3.

Figure 4:
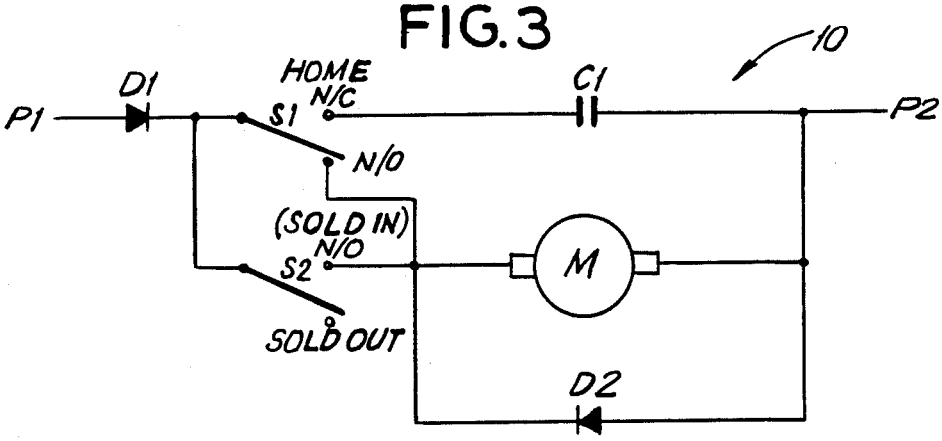
FIG. 4 is a schematic representation of a combined soldout and motor home sense circuit in accordance with the present invention.

The present invention can be best understood by reference to FIG. 4. A two wire interface P1 and P2 is shown from a control board (not shown) to a product dispenser board 10. The product dispenser board 10 consists of two switches (S1 and S2), a diode D2, a capacitor C1, and motor M. Diode D1 (isolation diode) is needed if a matrix C1 interface is used. Diode D2, a fly back diode, is used to clamp the inductive fly back of the motor M. If the motor M is home and the column is not soldout, switches S1 and S2 are positioned such that switch S1 directs the AC signal through capacitor C1 and switch S2 directs the DC bias current through the motor M. When off home switch S1 is in a position such that capacitor C1 is no longer in the circuit. This effectively blocks the AC signal from passing through product dispenser board 10. Appropriate detection circuitry and control logic decode the switch position and dispenser state. If switch S1 is in the home position and switch S2 is in the soldout position, current cannot flow through the motor M. If switch S2 is in the soldout position and switch S1 is not in the home position, the motor M will continue running until home, and open the power connection when it arrives there. Since the home and soldout condition leaves the motor circuit open it is possible to sense soldout through low current sense or timeout methods. As a result the motor will not move from home until the soldout condition is removed. Consequently, the need for one or more separate soldout sense line is eliminated.

We claim:

1. A vending apparatus comprising at least one product delivery means, said product delivery means comprising an electrically operated actuator for delivery of products, said actuator having a home position, a home switch responsive to the position of the actuator having a normally closed off home position and a normally open away from home position, and a soldout switch responsive to the absence of products in the vending machine, said soldout switch being in the closed position while product exists in the vending machine and in the open position when product is soldout, said soldout switch being wired in electrical series connection with the product delivery means, and in electrical parallel connection with the normally closed home switch contact; the home and soldout switches connected in circuit to form a logical AND condition such that the coincidence of soldout (out of product) and home conditions prevents the product delivery means from being actuated.

2. The vending apparatus of claim 1 wherein the home contact of the home switch is wired in electrical series connection with an impedance element, and the combination of home switch and impedance element are wired in electrical parallel combination to the series wiring of the soldout switch contact and product delivery means.

3. The vending apparatus of claim 1 further comprising a modulated power supply for supplying a modulated power signal to the electrically operated activator for the delivery of products is provided such that when the actuator is in the home position, the home switch and impedance element will pass the modulated signal and when the home switch is open, the modulated signal is filtered by the actuator and home position of the actuator by detecting the modulated power supply.

4. The vending apparatus of claim 3 wherein said soldout switch in the soldout position allows the actuator to be powered until the home switch is in the home position and prevents power from activating the actuator thereafter.

5. The vending apparatus of claim 1 wherein the position of the home and soldout switches are such that normal (non-soldout) operation causes no direct current to be switched by the home switch.

* * * * *

UNITED STATES PATENT AND TRADEMARK OFFICE
CERTIFICATE OF CORRECTION

PATENT NO. : 4,835,412

DATED : May 30, 1989

INVENTOR(S) : Hudis, Scott, B.; Lewis, Craig, A.

It is certified that error appears in the above—identified patent and that said Letters Patent is hereby corrected as shown below:

In col. 4, line 17, claim 3 insert -- , and means for detecting the operational condition of the actuator -- after "actuator".

Signed and Sealed this

Sixteenth Day of April, 1991

*Attest:*

HARRY F. MANBECK, JR.

*Attesting Officer*

*Commissioner of Patents and Trademarks*